United States Patent [19]

Ross

[11] Patent Number: 4,937,904

[45] Date of Patent: Jul. 3, 1990

[54] FITTED SHEET WITH SHEET RETAINER

[76] Inventor: Anthony J. Ross, 526-74th St., Anna Maria Island, Holmes Beach, Fla. 34217

[21] Appl. No.: 445,355

[22] Filed: Dec. 4, 1989

[51] Int. Cl.[5] ..... A47G 9/04

[52] U.S. Cl. ..... 5/497; 5/498; 24/72.5

[58] Field of Search ..... 5/482, 485, 486, 488, 5/494, 495, 496, 497, 498, 499, 500, 504, 508; 297/219; 24/72.5

[56] References Cited

U.S. PATENT DOCUMENTS

| | | | |
|---|---|---|---|
| 2,284,778 | 6/1942 | Treiber | 5/498 |
| 2,440,891 | 5/1948 | Bockhold | 5/499 X |
| 2,516,363 | 7/1950 | Block et al. | 5/500 |
| 2,727,253 | 12/1955 | Tomsic | 5/496 |
| 2,857,643 | 10/1958 | Tomsic | 5/496 X |
| 3,763,907 | 10/1973 | Hockley et al. | 5/484 X |
| 4,768,252 | 9/1988 | Ross | 5/497 |
| 4,825,489 | 5/1989 | Ross | 5/497 |

*Primary Examiner*—Eric K. Nicholson
*Attorney, Agent, or Firm*—Vernon J. Pillote

[57] ABSTRACT

A fitted sheet having a top panel and side and end panels for covering the top, sides and ends of the mattress. A one-piece elastic band of generally cylindrical cross-section has end portions attached by band end anchors to one end panel of the fitted sheet, and the band is slidably connected intermediate its ends by intermediate band connectors to opposite side panels of the sheet in a manner such that an intermediate section of the band extends between the side panels of the sheet generally parallel to the end panel and corner sections of the band extend generally diagonally from the intermediate band sections to the end panel. The intermediate band connectors are arranged to allow sliding of the band to substantially equalize the tension of the corner band sections with the intermediate band section of the elastic band.

5 Claims, 2 Drawing Sheets

Fig. 1.
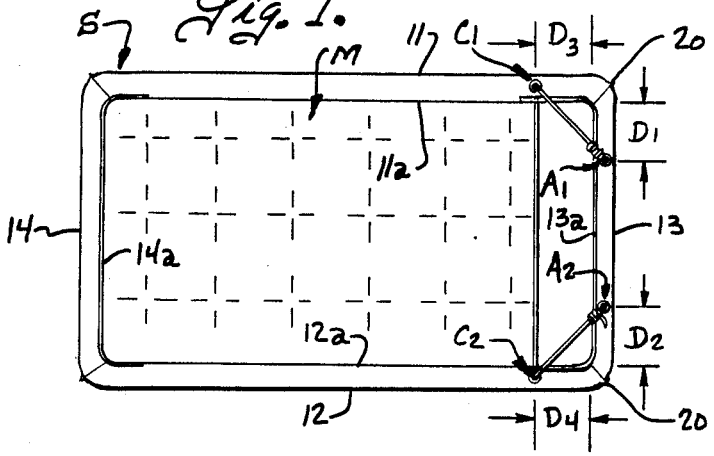
Fig. 2.
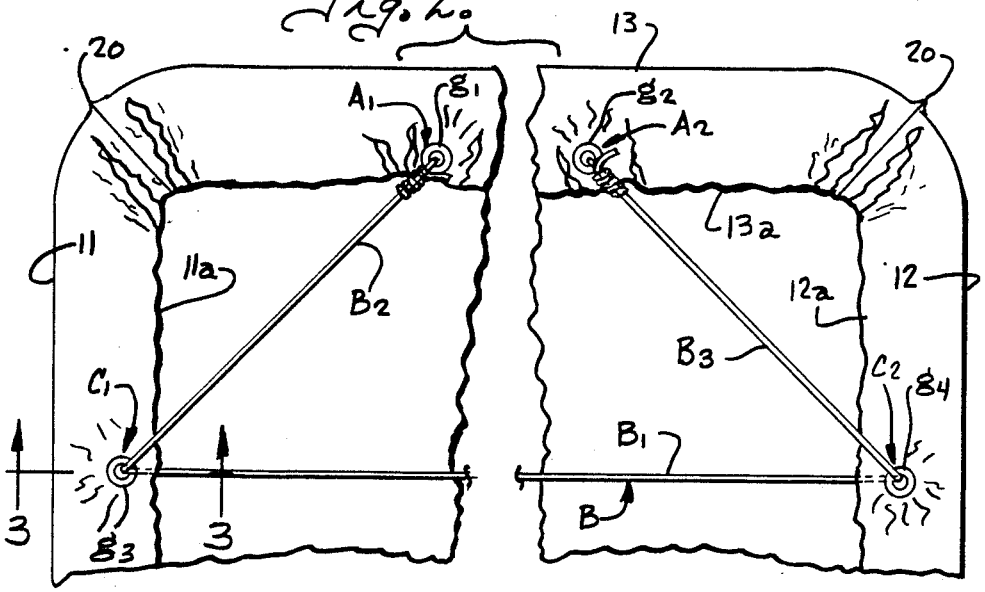
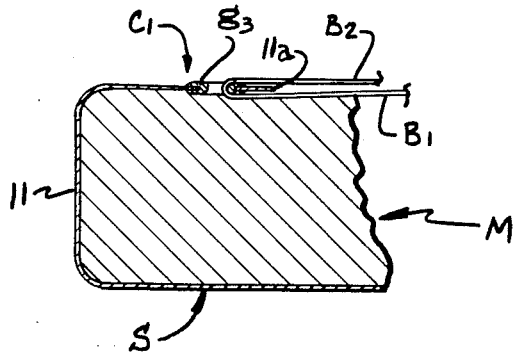
Fig. 3.

FITTED SHEET WITH SHEET RETAINER

BACKGROUND OF INVENTION

The applicant's prior U.S. Pat. Nos. 4,768,252 and 4,825,489 disclose a fitted sheet having an elastic cross extend therebetween at locations spaced from an end panel of the sheet, and elastic corner bands attached to the side panels of the sheet at the ends of the cross band and extending to the adjacent end panel. In U.S. Pat. No. 4,768,252, the cross bands and corner ends were formed of a flat elastic band with the ends of the cross bands and corner bands attached by stitching to the side and end panels of the fitted sheet. U.S. Pat. No. 4,825,489 and my copending U.S. application Ser. No. 07/365,353 filed June 13, 1989, disclose fitted sheets in which an elastic cross band and corner bands are formed as a harness that is detachably attached to the side and end panels of the sheet by fabric clasps. However, these prior arrangements used a flat elastic band and stitching to secure the cross band and corner bands to the fabric clasps.

The arrangements disclosed in my prior patents have been found effective to retain a fitted sheet in position on a mattress. However, the sewing operations required for attaching the cross band and corner bands to the sheet or to the fabric clasps added to the cost of production. Further, the tension in the cross band and the corner bands was dependent on the length of the cross and corner bands and points of attachment to the side and end panels of the sheet.

SUMMARY OF THE INVENTION

It is an object of the present invention to provide a fitted sheet with an elastic intermediate band section extending between the side panels of the sheet and elastic corner band sections extending diagonally from the ends of the intermediate band sections to the end panel of the sheet, which is more economical to manufacture and which substantially equalizes the tension in the intermediate band sections and corner band sections.

Accordingly, the present invention provides a fitted sheet having a top panel and first and second side panels and first and second end panels for covering the top, sides and an elastic sheet retainer comprising a one-piece elastic band of generally cylindrical cross-section having first and second ends, a first band end anchor means attaching the first end of the band to the first end panel adjacent the lower edge thereof at a location spaced a selected distance from the first side panel, a second band end anchor means attaching the second end of the band to the first end panel adjacent the lower edge thereof and at a location spaced a distance from the lower edge of the second side panel, first intermediate band engaging means on the first side panel adjacent the lower edge and spaced a distance from the lower edge of the first end panel slidably engaging the elastic band intermediate the ends thereof, second intermediate band engaging means on the second side panel adjacent the lower edge thereof spaced a distance from the lower edge of the first end panel and slidably engaging the elastic band intermediate the ends thereof, the first and second band end anchor means and the first and second intermediate band engaging means being arranged such that the elastic band has an intermediate section extending between the first and second intermediate band engaging means and spaced from the lower edge of the first end panel and first and second corner sections, the first corner section extending from the first intermediate band engaging means to the first band end anchor means and diagonally between the lower edges of the first side panel and first end panel, the second corner section extending from the second intermediate band engaging means to the second band anchor means and diagonally between the lower edges of the second side panel and the first end panel.

BRIEF DESCRIPTION OF DRAWINGS

FIG. 1 is a bottom view of the mattress with a fitted sheet and elastic sheet retainer applied thereto;

FIG. 2 a fragmentary bottom view of the mattress and fitted sheet and sheet retainer on a larger scale than FIG. 1;

FIG. 3 is a fragmentary sectional view taken on the plane 3—3 of FIG. 2;

DETAILED DESCRIPTION

Figure 4:
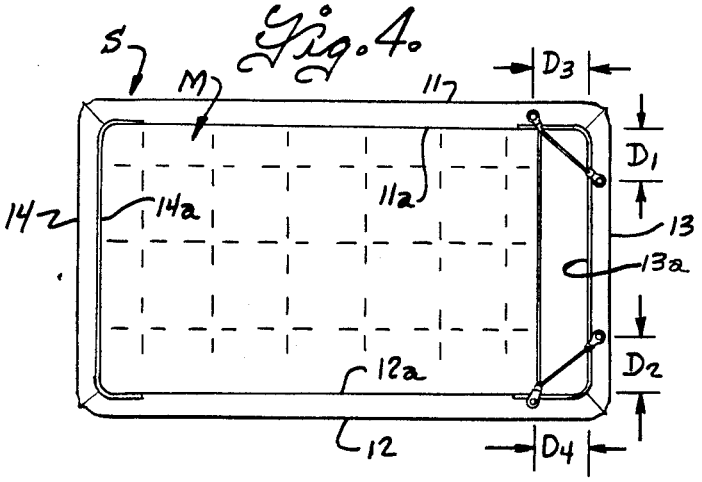
FIG. 4 is a bottom view of a mattress with a fitted sheet and harness-type elastic sheet retainer applied thereto.

Referring now more specifically to the embodiments of FIGS. 1–3, the reference S has been applied generally to a sheet for use on a rectangular mattress M. The sheet S is formed of a flexible fabric material and includes a top panel 10 (FIG. 3), first and second side panels 11 and 12, and first and second end panels 13 and 14. The top panel dimensioned to cover the top of the mattress and the side and end panels are connected together as by stitching to form generally vertical corners 20 at the corners of the mattress. The side and end panels cover the sides and ends of the mattress and the side panels 11 and 12 have lower side edges 11*a*and 12*a* respectively and the end panels 13 and 14 have lower side edges 13*a* and 14*a* respectively that are spaced from the top panel a distance greater than the height of the mattress on which the sheet is to be applied so that the lower portions on the side and end panels respectively extend below the bottom surface of the mattress and form side and end flaps that underlie the mattress. A one-piece elastic band B is connected to one of the end panels such as 13 at locations spaced from the side panels 11 and 12, and the band is slidably connected intermediate its ends to opposite side panels 11 and 12 at locations spaced from the end panel 13. The elastic band B has a generally cylindrical cross-section and is preferably of a type that includes a rubber core formed by one or more strands of rubber enclosed in a braided sheath of natural or synthetic fibers. The elastic band can be of relatively small size of the order of 1/16 to 3/32 inches in diameter and may, for example, be round cord elastic No. 56163-9 sold by Dritz corporation of Spartanburg, S.C. A first band end anchor means designated A1 in FIGS. 1 and 2 is provided for attaching a first end of the band to one end panel such as 13 adjacent the lower edge 13*a* thereof and at a location spaced a distance designated D1 in FIG. 1 from the lower edge 11*a* of one side panel 11, and a second band end anchor means A2 is provided for attaching a second end of the elastic band to the end panel 13 at a location adjacent its lower end and spaced a distance designated D2 in FIG. 1 from the lower edge 12*a* of the other side panel 12. A first intermediate band engaging means C1 constructed and arranged to slidably engage the elastic band intermediate its ends, is provided for connecting the elastic band to the first side panel 11 adjacent the lower edge thereof and at a location spaced a distance designated D3 in FIG. 1 from the lower edge 13*a* of the end panel 13. A second intermediate end engaging means designated C2, constructed and arranged to slidably engage the elastic band intermediate its ends, is provided for connecting the elastic band to the second side panel 12 adjacent its lower edge 12*a* at a location spaced a distance designated D4 in FIG. 1 from the lower edge 13*a* of the end panel 13. The first and second band anchor means A1 and A2 and the first and second intermediate band engaging means C1 and C2 are arranged such that the band has an intermediate portion B1 extending between the first and second intermediate band engaging means on side panels 11 and 12, and first and second corner sections B2 and B3. The first band corner section B2 extends from the first intermediate band engaging means C1 to the first band anchor means A1, and diagonally between the lower edges 11*a* and 13*a* of the first side panel and the first end panel. The second band corner section B3 extends from the second intermediate band engaging means C2 to the second band end anchor means A2 and diagonally between the lower edges of the second side panel 12*a* and the end panel 13. The distances designated D1 and D2 are preferably substantially equal to each other and of the order of six to eight inches. The distances designated D3 and D4 in FIG. 1 are also preferably substantially equal to each other so that the intermediate band section extends generally parallel to the lower edge of the end panel 13, and the distances D3 and D4 are preferably approximately the same as the distances designated D1 and D2, that is of the order of six to eight inches. The overall length of the band B is selected such that the band is under tension when the sheet with the elastic retainer band is mounted on the mattress. Since the band can slide relative to the intermediate band engaging means C1 and C2, the tension in the corner band sections B2 and B3 will tend to equalize with the tension in the intermediate band section B1 and with each other.

In the embodiments of FIGS. 1–3 the band end attaching means A1 and A2 are in the form of grommets designated g1 and g2 respectively which can be made of plastic, metal or a sewn button hole. The ends of the elastic band are inserted through the openings in the grommets and secured upon itself as by in a knot or clamp. The intermediate band engaging means C1 and C2 are also conveniently in the form of grommets designated g3 and g4 respectively, which have an opening therethrough that slidably receives the band intermediate its ends.

Figure 5:
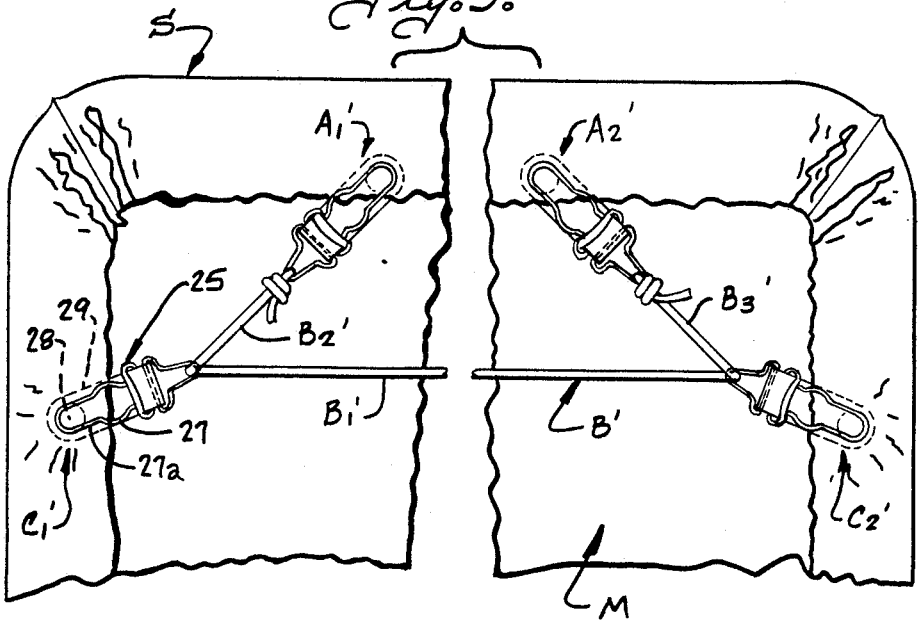
FIG. 5 is a fragmentary bottom view of a mattress and fitted sheet with the harness-type sheet retainer applied thereto and showing parts of on a larger scale than FIG. 4.
Figure 6:
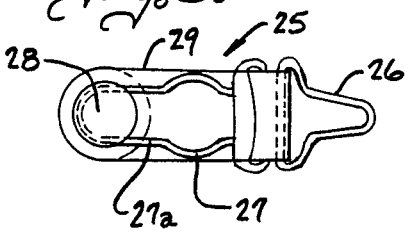
FIG. 6 is plan view of a fabric clasp having one form of band engaging member.

The embodiments of FIGS. 4–6 is similar to that disclosed in FIGS. 1–3 and like numerals are used to designate the same parts and like numerals followed by the postscript ′ are used to designate modified parts. In this embodiment, the band end attaching means designated A1′ and A2′ comprise fabric clasps for detachably connecting the ends of the elastic band B′ to one end panel 13 of the fitted sheet, and the intermediate band engaging means designated C1′ and C2′ also comprise fabric clasps for detachably engaging the side panels of the fitted sheet. The fabric clasps are advantageously of like construction and like numerals are used to designate the same parts. As shown in FIGS. 5 and 6, fabric clasps each have a detachable fabric gripping means 25 and a band receiving member 26 herein shown formed of wire. The fabric gripping means is of the type that includes a keyhole-shaped button receiving loop 27 having legs 27*a* for slidably receiving a headed button 28. As is conventional, the headed button 28 is mounted on a flexible connector 29 such as a cloth strip that is otherwise attached to the button receiving loop 27 at a location remote from the legs 27*a*, to retain the button on the fabric clasp while allowing movement of the button into and out of the loop 27.

The ends of the band B are inserted through the band receiving members 26 on the band end connectors A1′ and A2, and then secured upon itself as by a knot or clamp as indicated at K1 and K2. The band receiving members 26 on the intermediate band engaging means C1′ and C2′ are arranged to slidably engage the band. With this arrangement, the elastic retaining harness can be readily attached to the fitted sheet for retaining the fitted sheet on the mattress, and removed from the sheet for laundering. As described in connection with the embodiment of FIGS. 1–3, the band end anchor means A1′ and A2′ are connected to the end panel of the fitted sheet adjacent its lower edge at locations spaced a distance spaced D1 and D2 from the lower edge of the side panels 11 and 12 respectively. The intermediate band engaging means C1′ and C2′ are attached to the side panels 11 and 12 adjacent their lower edges at locations spaced distances designated D3 and D4 in FIG. 4 from the lower edge of the end panel 13. Distances D1–D4 are preferably of the order of about six to eight inches and such that the intermediate portion B1′ of the band B′ extends between the intermediate band engaging means C1′ and C2′ generally parallel to the end panel 13, and corner portions B2′ and B3′ extend from the intermediate band engaging means C1′ and C2′ to the respective band end anchor means A1′ and A2′, and generally diagonally between the associated side panels and the end panel 13. When connected to the sheet, the band B′ can slide relative to the band engaging member 26 on the intermediate band engaging means to substantially equalize the tension in the corner bands with that of the intermediate band section.

Figure 7:
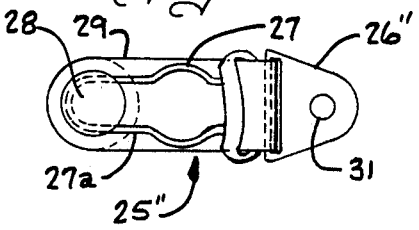
FIG. 7 is a plan view of a fabric clasp having a modified band engaging member.

The fabric clasp designated 25″ in FIG. 7 is similar to that shown in FIG. 6 and like numerals are used to designate corresponding parts, and like numerals with the postscript ″ to designate modified parts. In this embodiment, the band engaging member 26″ is formed of flat metal or plastic stock and has an aperture 31 for slidably receiving the band B′.

From the foregoing it is believed that the construction and use of the sheet and elastic retainer band will be readily understood. The intermediate band engaging means slidably engage the band intermediate its ends and connect the band to the opposite side panels in a manner such that the tension in the corner bands become substantially equalized with the tension in the intermediate band section. Further, the disclosed arrangement avoids the necessity of sewing the elastic bands either to the sheet or to fabric clasps which connect the band to the sheet, and thus reduces the overall cost of production. While the elastic retaining band has herein been shown applied to one end of the fitted sheet, it is apparent that a similar retaining band can be provided at the other end of the sheet, if desired.

The embodiments of the invention in which an exclusive property or privilege is claimed are defined as follows:

1. In a fitted sheet having a top panel, first and second side panels and first and second end panels for covering the top, sides and ends respectively of a mattress with adjacent ends of the sides and end panels connected together to form corners, the side and end panels each having lower edges extending lengthwise thereof and spaced from the top panel, the improvement comprising a one-piece elastic band of generally cylindrical cross-section and having first and second ends, a first band end anchor means for attaching the first end of the band to the first end panel adjacent the lower edge thereof at a location spaced a distance from the lower edge of the first side panel, a second band end anchor means for attaching the second end of the band to the first end panel adjacent the lower edge thereof and at a location spaced a distance from the lower edge of the second side panel, first intermediate band engaging means slidably engaging the elastic band intermediate its ends for connecting the elastic band to the first side panel adjacent the lower edge thereof and at a location spaced a distance from the lower edge of the first end panel, second intermediate band engaging means slidably engaging the elastic band intermediate the ends thereof for connecting the elastic band to the second side panel adjacent the lower edge thereof and at a location spaced a preselected distance from the lower edge of the first end panel, the first and second band anchor means and the first and second intermediate band engaging means being arranged on the sheet such that the elastic band has an intermediate band section extending between the first and second intermediate band engaging means and spaced from the lower edge of the first end panel and first and second band corner sections, the first band corner section extending from the first intermediate band engaging means to the first band end anchor means and diagonally between the lower edges of the first side panel and first end panel, and the second band corner section extending from the second intermediate band engaging means to the second band end anchor means and diagaonally between the lower edges of the second side panel and the first end panel.

2. A fitted sheet according to claim 1 wherein said first and second intermediate band engaging means comprise first and second grommets respectively fixed to the first and second side panels and slidably engaging said elastic band intermediate the ends thereof.

3. A fitted sheet according to claim 1 wherein said first and second intermediate band engaging means comprise first and second grommets respectively fixed to the first and second side panels and slidably engaging said elastic band intermediate the ends thereof, said first and second band end anchor means include third and fourth grommets fixed to the first end panel, said first and second ends of the elastic band respectively extending through the third and fourth grommets and anchored thereto.

4. A fitted sheet according to claim 1 wherein said first intermediate band engaging means comprise first and second fabric clasps each having detachable fabric gripping means and a band receiving member slidably engaging the elastic band intermediate the ends thereof.

5. A fitted sheet according to claim 1 wherein said first and second intermediate band engaging means comprise first and second fabric clasps each having detachable fabric gripping means and a band receiving member slidably engaging the elastic band intermediate the ends thereof, said first and second band end anchor means comprise third and fourth fabric clasps each having detachable fabric gripping means and means fixedly attaching the first and second ends of the elastic band to the third and fourth fabric clasps respectively.

* * * * *